US005842635A

United States Patent [19]

Okabe et al.

[11] Patent Number: 5,842,635

[45] Date of Patent: Dec. 1, 1998

[54] VARIABLE PERFORMANCE VISCOUS FLUID HEATER

[75] Inventors: Takanori Okabe; Takashi Ban, both of Kariya, Japan

[73] Assignee: Kabushiki Kaisha Toyoda Jidoshokki Seisakusho, Kariya, Japan

[21] Appl. No.: 944,388

[22] Filed: Oct. 6, 1997

[30] Foreign Application Priority Data

Oct. 8, 1996 [JP] Japan ..... 8-267149

[51] Int. Cl.[6] ..... B60H 1/02

[52] U.S. Cl. ..... 237/12.3 R; 122/26; 126/247

[58] Field of Search ..... 237/12.3 B, 12.3 R; 126/247; 122/26

[56] References Cited

U.S. PATENT DOCUMENTS

| | | | |
|---|---|---|---|
| 4,273,075 | 6/1981 | Freihage | 122/26 |
| 4,277,020 | 7/1981 | Grenier | 237/1 R |
| 4,351,426 | 9/1982 | Bopp | 192/58 B |
| 4,454,861 | 6/1984 | Greiner . | |
| 5,704,320 | 1/1998 | Ban et al. | 123/142.5 R |

FOREIGN PATENT DOCUMENTS 398107 10/1991 Japan .

*Primary Examiner*—Henry A. Bennett
*Assistant Examiner*—Derek S. Boles
*Attorney, Agent, or Firm*—Brooks Haidt Haffner & Delahunty

[57] ABSTRACT

An improved viscous fluid type heater is disclosed. The heater has a heating chamber that has a inner peripheral surface and a pair of inner side surfaces and a heat exchange chamber disposed adjacent to the heating chamber. The heating chamber houses a cylindrical rotor that has an outer peripheral surface and a pair of outer side surfaces. The outer peripheral surface is opposed to the inner peripheral surface by a first space. The outer side surface is opposed to an associated inner side surface by a second space that communicates the first space. The rotor rotates and shears viscous fluid to generate heat in the spaces. The heat generated in the spaces is transmitted to the heat exchange chamber to heat circulating fluid circulating in the heat exchange chamber and an external fluid circuit. The rotor has a storing chamber defined therein. A first passage connects the first space with the storing chamber to shift the viscous fluid from the storing chamber to the first space. A second passage connects the second space with the storing chamber to shift the viscous fluid from the second spaces to the storing chamber. A valve actuated in association with heat generating capacity of the rotor to adjust flow of the viscous fluid passing through the first passage.

20 Claims, 3 Drawing Sheets

VARIABLE PERFORMANCE VISCOUS FLUID HEATER

BACKGROUND OF THE INVENTION

1. Field of the Invention

The present invention relates to a viscous fluid heater that generates heat by shearing viscous fluid in a heating chamber with a rotor and transmits the generated heat to circulating fluid in a heat exchange chamber. More particularly, the present invention pertains to a viscous fluid heater that is capable of changing its heat generating capacity.

2. Description of the Related Art

Engine-driven viscous fluid heaters for vehicles are known as auxiliary heat sources. For example, Japanese Unexamined Utility Model Publication No. 3-98107 discloses a variable performance viscous fluid heater that is incorporated in a vehicle heating system.

The heater includes front and rear housings coupled to each other. A heating chamber is defined between the coupled housings. Also, a water jacket (heat exchange chamber) is defined about the heating chamber. A drive shaft is rotatably supported in the front and rear housings by a bearing mechanism. The heating chamber accommodates a disk-shaped rotor that is fixed to the drive shaft to integrally rotate with the shaft. A plurality of circular fins are formed on the front and rear faces of the rotor about the axis of the drive shaft. Also, respective pluralities of fins are formed on the inner walls of the heating chamber that face front and rear faces of the rotor. These fins on the rotor and the fins on the inner walls of the heating chamber are alternately arranged in the heating chamber. In other words, each fin on the rotor is located between a corresponding pair of fins on the inner wall of the chamber. Therefore, a labyrinthine clearance is defined between the each face of the rotor and the corresponding inner wall of the heating chamber. Viscous fluid (e.g. silicone oil) is contained in the heating chamber and occupies the labyrinthine clearances. When the drive force of an engine is transmitted to the drive shaft, the rotor is rotated integrally with the shaft in the heating chamber. The rotor shears the viscous fluid in the labyrinthine clearances thereby generating heat based on fluid friction. Heat generated in the heating chamber is transmitted to circulating water in the water jackets. The heated water is then used by an external heating circuit for heating the passenger compartment.

The heater also has a casing coupled to the lower end of the coupled front and rear housings. The casing includes an upper casing piece, a lower casing piece and a diaphragm located between the casing pieces. The diaphragm divides the inner space of the casing into two chambers. An upper chamber, which is defined by the upper casing piece and the diaphragm, functions as a control chamber. The heating chamber defined in the housings is communicated with the atmosphere by a through hole formed in the top wall and is also communicated with the control chamber by a communicating pipe provided in the upper casing piece. A spring is provided in a lower chamber, which is defined by the lower casing piece and the diaphragm, and extends between the bottom of the lower casing piece and the diaphragm for urging the diaphragm upward. Further, the lower chamber is communicated with a manifold of an engine for introducing vacuum pressure into the lower chamber. The diaphragm is therefore vertically displaced by the force of the spring and the vacuum pressure to an equilibrium position thereby changing the volume of the control chamber.

The heat generating capacity of this heater is varied in the following fashion. When heating is excessive, the diaphragm is displaced downward by vacuum pressure introduced from the manifold, which increases the volume of the control chamber. This draws part of the viscous fluid from the heating chamber into the control chamber. Accordingly, the amount of viscous fluid subjected to shearing is decreased. This lowers the heat output per revolution, accordingly. When the heating is insufficient, on the other hand, the diaphragm is displaced upward by the force of the spring. This decreases the volume of the control chamber thereby sending viscous fluid, which is temporarily stored in the control chamber, back to the heating chamber. The amount of viscous fluid subjected to shearing is increased, accordingly. This increases the heat output per revolution.

However, in the above described prior art viscous fluid heater, the control chamber is provided below the heating chamber. Therefore, when reducing the heat output, viscous fluid in the heating chamber is moved downward to the control chamber only by its own weight. When the rotor is rotating, however, viscous fluid is not moved smoothly and rapidly downward. The labyrinthine clearances between the inner walls of the heating chamber and the front and rear faces of the rotor further hinder the downward flow of viscous fluid. This heater therefore cannot quickly lower the heat output when the temperature is excessive. If viscous fluid is heated to exceed its maximum heat resistance, the fluid quickly deteriorates. Deteriorated fluid is not capable of generating heat when subjected to shearing.

Further, the rotor of the above heater has a disk-like shape, and the axial length of the rotor is shorter than the diameter of the heater, since the fins for defining the labyrinthine clearances need to be formed on the front and rear faces. Shearing is chiefly performed by the fins on the faces of the rotor. The farther a fin is from the axis of the rotor, the greater the velocity of the fin, or the speed of shearing. Thus, to increase the heat capacity of the heater, the diameter of the rotor needs to be enlarged, that is, the radial dimension of the heater needs to be increased. However, it is harder to obtain the space for the heater in the engine compartment in a vehicle when the diameter of the heater is increased. A larger heater also limits the locations of other auxiliary components in the engine compartment.

SUMMARY OF THE INVENTION

Accordingly, it is an objective of the present invention to provide a viscous fluid heater that has a shape suitable for mounting on a vehicle or on other machines without degrading the heat production of the heater. It is another objective of the present invention to provide a variable performance viscous fluid heater that has an improved controllability in increasing and reducing its heat output. It is yet another objective of the present invention to provide a variable performance viscous fluid heater that prevents viscous fluid from being deteriorated by excessive heat and thus maintains the heat generating capacity.

To achieve the foregoing and other objectives and in accordance with the purpose of the present invention, a viscous fluid heater including a heating chamber that has an inner peripheral surface and an inner side surface and a heat exchange chamber disposed adjacent to the heating chamber is provided. The heating chamber houses a cylindrical rotor having an outer peripheral surface and an outer side surface. The outer peripheral surface is opposed to the inner peripheral surface of the heating chamber by a first space and the side surface is opposed to an associated inner side surface of the heating chamber by a second space communicating with the first space. The rotor rotates and shears viscous fluid to generate heat in the spaces. The heat generated in the spaces is transmitted to the heat exchange chamber to heat circulating fluid, which circulates in the heat exchange chamber and an external fluid circuit and passes through the heat exchange chamber. The heater further includes a storing chamber defined in the rotor, a first passage, a second passage and valve means. The first passage connects the first space with the storing chamber to shift the viscous fluid from the storing chamber to the first space. The second passage connects the second space with the storing chamber to shift the viscous fluid from the second space to the storing chamber. The valve means is actuated in association with the heat generating capacity of the rotor to adjust the flow of the viscous fluid passing through at least one of the first passage and the second passage.

BRIEF DESCRIPTION OF THE DRAWINGS

The invention, together with objects and advantages thereof, may best be understood by reference to the following description of the presently preferred embodiments together with the accompanying drawings.

DETAILED DESCRIPTION OF THE PREFERRED EMBODIMENTS

A first embodiment of a viscous fluid heater according to the present invention that is incorporated in a heating apparatus of a vehicle will now be described with reference to FIG. 1.

Figure 1:
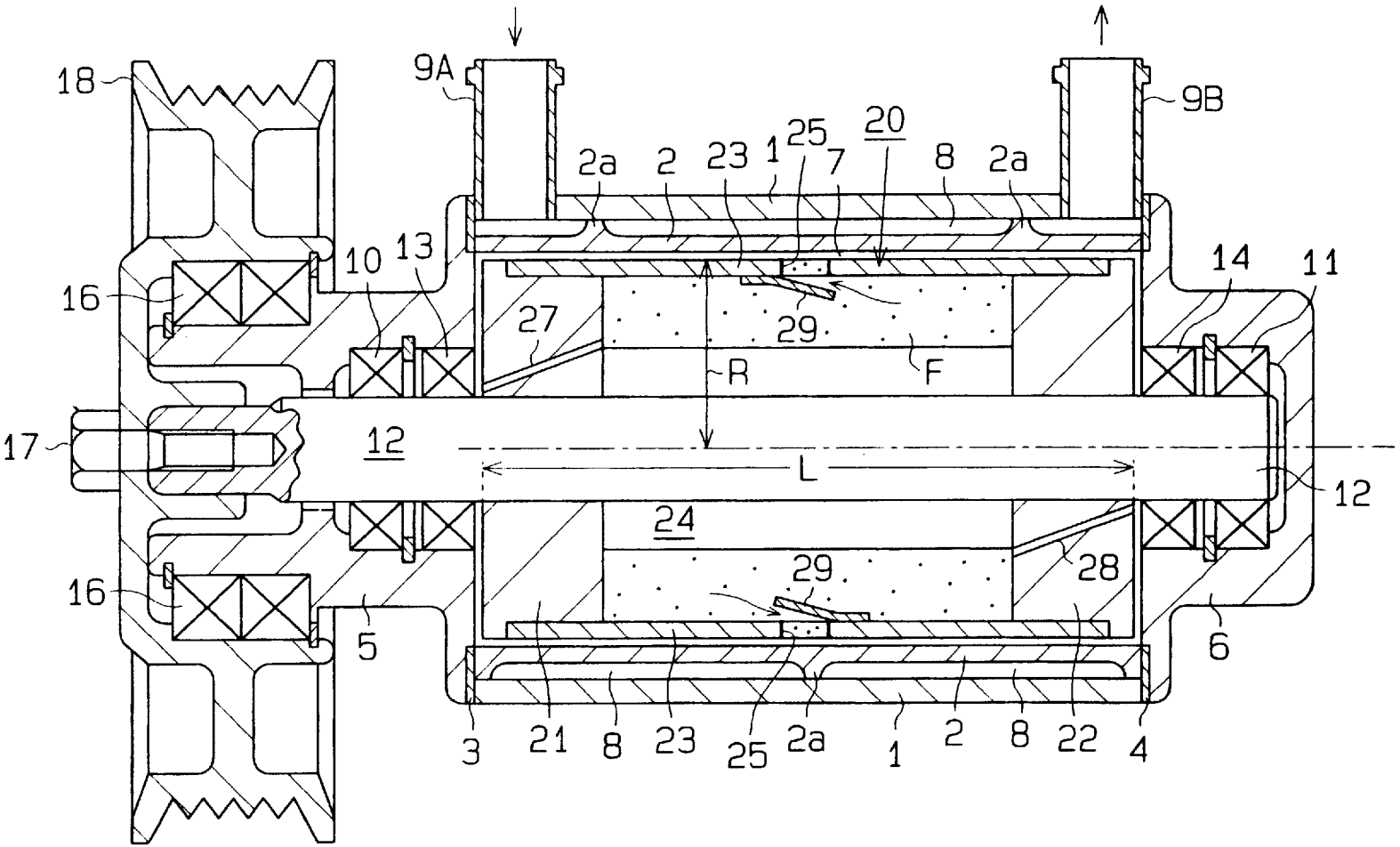
FIG. 1 is a cross-sectional view illustrating a viscous fluid heater according to a first embodiment of the present invention.

As shown in FIG. 1, the housing of the viscous fluid heater according to the first embodiment includes a cylindrical middle housing 1, a cylinder block 2, a front housing 5 and a rear housing 6. The cylinder block 2 has a helical rib 2*a*, and is press fitted into the middle housing 1. The front housing 5 and the rear housing 6 are secured to the front and rear end faces of the middle housing 1 and the cylinder block 2 with gaskets 3 and 4 in between, respectively. The inner wall of the cylinder block 2 and the front and rear housings 5, 6 define a heating chamber 7.

The helical rib 2*a* on the cylinder block 2 is pressed against the inner wall of the middle housing 1. A water jacket 8 is defined between the periphery of the cylinder block 2 and the inner wall of the middle housing 1. The water jacket 8 functions as a heat exchange chamber. An inlet port 9A is formed at the front end of the periphery of the middle housing 1 for introducing circulating water into the water jacket 8 from a heating circuit (not shown) provided in the vehicle. An outlet port 9B is formed at the rear end of the periphery of the middle housing 1 for returning circulating water in the water jacket 8 to the circuit. The rib 2*a* in the water jacket 8 functions as circulating fluid guiding means for defining a helical passage connecting the inlet port 9A with the outlet port 9B.

A drive shaft 12 is rotatably supported in the housing by bearings 10 and 11 that are located in the front housing 5 and in the rear housing 6, respectively. An oil seal 13 is located in the front housing 5 at a position adjacent to the heating chamber 7. The oil seal 13 functions as a shaft seal. Similarly, an oil seal 14 is located in the rear housing 6 at a position adjacent to the heating chamber 7. The oil seal 14 also functions as a shaft seal. The oil seals 13, 14 make the heating chamber 7 a fluid-tight inner space while the middle main part of the drive shaft 12 is accommodated in the heating chamber 7. A rotor 20, which is secured to the drive shaft 12, occupies the heating chamber 7. The rotor 20 rotates integrally with the drive shaft 12.

The rotor 20 includes a pair of aluminum disks 21 and 22 and a cylinder 23. The disks 21, 22 are secured to the drive shaft 12 and located in the heating chamber 7 with a predetermined distance therebetween. The cylinder 23 is supported by and located between the disks 21 and 22. Accordingly, the rotor 20 constitutes a hollow drum. The inner space of the rotor 20 functions as a storing chamber 24. The cylinder 23 defines the periphery of the rotor 20, while the disks 21 and 22 define the ends of the rotor 20.

The length L of the rotor 20 is greater than its radius R. The axis of the rotor 20 is the same as the axis of the drive shaft 12. The radius R of the rotor 20 is determined such that a narrow clearance is defined between the rotor 20 and the inner wall of the heating chamber 7. This peripheral clearance will hereinafter be referred to as a peripheral region of the heating chamber 7. The length L of the rotor 20 is determined such that narrow clearances are defined between the ends (outer faces of the disks 21, 22) of the rotor 20 and the inner walls of the heating chamber 7 (inner walls of the housings 5, 6). These clearances at the ends of the rotor 20 are hereinafter referred to as end face regions of the heating chamber 7. The end face regions include central end regions of the heating chamber 7 located close to the axis of the rotor 20.

A plurality of holes 25 (only two of which are shown FIG. 1) are formed in the axially center portion of the cylinder 23. The holes 25 are spaced apart at equal angular intervals. For example, if the number of the holes 25 is two, the holes 25 are spaced apart by 180 degrees and if four, the holes 25 are spaced apart by 90 degrees. Therefore, at least one of the holes 25 is always located below the drive shaft 12 regardless of the position of the rotor 20, and at least one of the holes 25 is always located above the drive shaft 12. The holes 25 function as supply passages for viscous fluid and communicate the storing chamber 24 with the peripheral region of the heating chamber 7.

Bimetallic valve flaps 29 are provided on the inner wall of the storing chamber 24 (inner surface of the cylinder 23) to correspond to the holes 25. The valve flaps 29 vary the size of the openings of the holes 25 in accordance with the temperature. Specifically, the valve flaps 29 open the holes 25 when the heater is not operating or is generating little heat, and the valve flaps 29 are deformed to close the holes 25 as the temperature of the viscous fluid increases.

Further, passages 27 and 28 are formed in the disks 21 and 22, respectively. The passages 27 and 28 are inclined with respect to the rotor axis and extend from areas close to the drive shaft 12 at respective ends of the rotor 20 to areas close to the respective ends of the storing chamber 24. Each of the passages 27 and 28 communicates the storing chamber 24 with the associated end face region of the heating chamber 7. The cross-sectional area of each of the passages 27, 28 is smaller than the cross-sectional area of any one of the holes 25.

The heating chamber 7 contains a predetermined amount of silicone oil F, which is a viscous fluid. Since the storing chamber 24 is communicated with the heating chamber 7, the silicone oil F enters the storing chamber 24 through the holes 25. The volume of the storing chamber 24 is represented by V1 and the total volume of the clearances between the rotor 20 and inner walls of the heating chamber 7 is represented by V2. The amount Vf of the silicone oil F in the chambers 7 and 24 is determined such that the fill factor of the oil F is fifty to seventy percent of the combined volumes (V1+V2) of the chambers 7 and 24. In FIG. 1, the silicone oil F is forced against the inner wall of the storing chamber 24 by centrifugal force because the rotor 20 is rotating at a normal speed.

A pulley 18 is rotatably supported on the front housing 5 by a bearing 16 located on the front housing 5. The pulley 18 is secured to the front end (distal end) of the drive shaft 12 by a bolt 17. A belt (not shown) is engaged with the periphery of the pulley 18 and operably couples the pulley 18 with a vehicle engine, which functions as an external drive source. Thus, the drive force of the engine is transmitted to the drive shaft 12 by the pulley 18 and rotates the rotor 20 integrally with the drive shaft 12. This causes the rotor 20 to shear the silicone oil in the clearances between the rotor 20 and the inner wall of the heating chamber 7. Heat generated in the chamber 7 is transmitted to circulating water in the water jackets 8 through the cylinder block 2. The heated water is then used by the heating circuit for heating the passenger compartment The heat generating capacity of the heater will now be assessed. The coefficient of viscosity of the viscous fluid F is represented by $\mu$, the clearance between the periphery of the rotor 20 and the corresponding inner wall of the heating chamber 7 is represented by $\delta_1$, the clearance between each end of the rotor 20 and the corresponding inner wall of the heating chamber 7 is represented by $\delta_2$ and the angular velocity of the rotor 20 is represented by $\omega$. The heat value $Q_1$ at each end face region is represented by the following equation:

$$Q_1=\pi\mu\omega^2R^4/\delta_2$$

The heat value $Q_2$ at the periphery region is represented by the following equation:

$$Q_2=\pi\mu\omega^2R^3L/\delta_1$$

Since the periphery of the rotor 20 functions as a main shearing surface, $\delta_1$ is set smaller than $\delta_2$ ($\delta_1<\delta_2$). Further, since the radius R is shorter than the length L, $Q_1$ is much smaller than $Q_2$ ($Q_1<<Q_2$). That is, the heater has the greater heat value $Q_2$ at the periphery of the drum rotor 20 is much greater than that at an end.

Flow of the silicone oil F and self-control of the production of heat will now be described.

When the drive shaft 12 and the rotor 20 are not rotating, the silicone oil F in the storing chamber 24 communicates with the silicone oil F in the heating chamber 7 by one or more of the holes 25 located below the drive shaft 12. Thus, the level of the oil F in the storing chamber 24 is equal to the level of the oil F in the heating chamber 7. Since the amount Vf of the silicone oil F is set to fill fifty to seventy percent of the combined volume of the chambers 7 and 24, the oil F settles at a level above the axis of the drive shaft 12.

If the drive shaft 12 and the rotor 20 start to rotate, the silicone oil F about the rotor 20 is subjected to shearing. At the same time, as shown in FIG. 1, the silicone oil F in the storing chamber 24 is forced against the inner wall of the chamber 24 by centrifugal force. The centrifugal force also pushes the oil F out to the clearance between the rotor 20 and the inner wall of the heating chamber 7. In this manner, the silicone oil F is supplied from the storing chamber 24 to the peripheral region of the heating chamber 7. This causes the gas (air) in the peripheral region to escape into the storing chamber 24. Therefore, the entire peripheral region is substantially filled with the silicone oil F with no air trapped therein.

In the end face regions at the front and rear ends of rotor 20, rotation of the rotor 20 causes the silicone oil F to flow toward the drive shaft 12 because of the Weissenberg effect. The oil F gathered about the drive shaft 12 is returned into the storing chamber 24 through the passages 27, 28. On the other hand, the silicone oil F in the storing chamber 24 is constantly supplied to the peripheral region through the holes 25 by centrifugal force. Therefore, when the rotor 20 is rotating, the silicone oil F is circulated through the storing chamber 24, the peripheral region and the end face regions.

If the temperature of the silicone oil F increases beyond a certain level by continuous operation of the heater, each bimetallic valve flap 29 is deformed to close the associated hole 25. In other words, as the temperature of the silicone oil F increases, each valve flap 29 gradually reduces the opening of the associated hole 25. This reduces the amount of the oil F supplied to the peripheral region of the heating chamber 7. Accordingly, the heater is self-controlled to limit the heat produced per revolution by shearing.

The valve flaps 29 completely close the holes 25 when the temperature of the silicone oil F is excessive. This completely stops the supply of the oil F from the chamber 24 to the peripheral region. In this state, the oil F keeps flowing from the end faces of the rotor 20 to the storing chamber 24. Guided by the Weissenberg effect, the amount of the oil F in the peripheral region gradually decreases. This lowers the heat production per revolution thereby lowering the temperature of the oil F. When the temperature of the oil F is lowered to a certain level, the valve flaps 29 re-open the holes 25. Thus, the oil F is supplied from the chamber 24 to the peripheral region through the holes 25 again, which increases the heat production per revolution.

If the drive shaft 12 and the rotor 20 are stopped, at least one of the holes 25 is located below the drive shaft 12. The silicone oil F that has been supplied to the peripheral and end face regions is returned to the storing chamber 24. Therefore, stopping the rotor 20 restores the level of the silicone oil F in the storing chamber 24 to the initial level.

The advantages of the first embodiment will now be described.

As described above, the bimetallic valve flaps 29 open and close the holes 25 in accordance with the temperature of the silicone oil F, which regulates the amount of fluid shearing per revolution. Thus, the temperature of the silicone oil is prevented from increasing excessively. The silicone oil F is therefore not prematurely deteriorated by heat.

The passages 27, 28 are inclined with respect to the axis of the drive shaft 12 and extend from areas on the sides of the rotor 20 close to the drive shaft 12 to areas of the inner walls of the storing chamber 24 close to the periphery of the rotor 20. Therefore, when the silicone oil F is returned from the ends of the chamber 7 about the drive shaft 12 to the chamber 24, the flow of the oil F is aided not only by the Weissenberg effect but also by centrifugal force. This smoothes the forced circulation of the silicone oil F in the heating chamber 7.

The storing chamber 24 is defined in the rotor 20, and the silicone oil F is supplied to the peripheral region and end face regions from the chamber 24. This construction increases the amount of the silicone oil F that can be subjected to shearing. Since it takes a relatively long time until the entire amount of the silicone oil F in the chambers 7 and 24 completely deteriorates, the silicone oil F can be used for a considerably long time before it needs to be changed. This reduces the maintenance needs of the heater. Also, defining the storing chamber 24 in the rotor 20 economizes the space in the heater and thereby reduces the size of the heater.

As long as the temperature of the silicone oil F is within a predetermined permissible range, the bimetallic valve flaps 29 keep the holes 25 opened. In this state, the oil F circulates between the storing chamber 24 and the peripheral and end face regions via the holes 25 and the passages 27, 28. Thus, the silicone oil F does not linger in the peripheral or end face regions and is not quickly degraded. Also, the oil F in the chambers 7 and 24 is uniformly subjected to shearing by the rotor 20. The silicone oil F can be used for a considerably long time before it needs to be changed.

As described above, the total amount Vf of the silicone oil F in the heating chamber 7 (including the storing chamber 24) is determined such that the fill factor of the oil F is seventy percent or lower relative to the combined volume (V1+V2) of the chambers 7 and 24. In other words, at least thirty percent of space of the chambers 7 and 24 is unoccupied. The unoccupied space functions as a buffer space that allows expansion of the oil F when it is heated and thus prevents the pressure in the chambers 7 and 24 from increasing excessively. The unoccupied space is mostly located in the storing chamber 24 when the rotor 20 is rotating and not in the peripheral and end face regions about the rotor 20. Therefore, the unoccupied space does not lower the heat generating capacity of the heater. In this construction, there is little oil F in the peripheral and end face regions when the heater starts operating. The torque shock caused by starting the heater is thus reduced.

Since the heating chamber 7 is air-tight, the chamber 7 is not communicated with the outside air. This prevents water in the atmospheric air from being mixed with the silicone oil F. The heat generating capacity of the heater and the longevity of the silicone oil F are improved, accordingly.

A second embodiment of the present invention will now be described. In the first embodiment, the valve flaps 29 are bimetallic. However, in the second embodiment, the valve flaps 29 are reed valve flaps. Each reed valve flap 29 has a predetermined elasticity and completely opens the holes 25 when the rotor 20 is not rotating. As the angular velocity of the rotor 20 increases, the centrifugal force acting on the valve flaps 29 increases, accordingly, and deforms the valve flaps 29 to close the holes 25 against the force of the flaps 29. In other words, the reed valve flaps 29 function to control the opening of the holes 25 in accordance with the angular velocity of the rotor 20.

More specifically, when the heater is operating, an increase in the angular velocity of the rotor 20 generates an increased centrifugal force that deforms each reed valve flap 29 to close the corresponding hole 25. That is, as the angular velocity of the rotor 20 increases, the reed valve flaps 29 further reduce the opening of the holes 25. As a result, the supply of oil from the storing chamber 24 to the peripheral region about the rotor 20 is reduced, and the amount of shearing and resultant heat produced per revolution are reduced accordingly. If the angular velocity of the rotor 20 reaches a predetermined angular velocity ω1, the centrifugal force acting on the reed valve flaps 29 becomes greater than the opening spring force of the valve flaps 29 and causes the valve flaps 29 to completely close the holes 25.

Even if the supply of the oil F from the chamber 24 to the peripheral region is completely stopped, the oil F keeps flowing in to the storing chamber 24 from the end faces of the rotor 20. Guided by the Weissenberg effect, the amount of the oil F in the peripheral region gradually decreases. This lowers amount of the heat generated per revolution. In this manner, like the first embodiment, the silicone oil F is not heated excessively.

When the angular velocity of the rotor 20 is lower than the predetermined angular velocity ω1, the opening spring force of the valve flaps 29 is greater than the opposing centrifugal force acting thereon. Therefore, the flaps 29 open the holes 25. Then, the oil F is supplied from the chamber 24 to the peripheral region about the rotor 20 again, and the heat production is restored. In this manner, as in the first embodiment, the amount of fluid shearing per revolution is self-controlled by the reed valve flaps 29, which control the opening of the holes 25 based on the angular velocity of the rotor 20, and the temperature of the oil does not increase excessively. The advantages of the second embodiment are substantially the same as those of the first embodiment.

A third embodiment of the present invention will now be described with reference to FIG. 2. The viscous fluid heater of the third embodiment has the same basic construction as the viscous fluid heaters of the first and second embodiment of FIG. 1. However, the heater of the third embodiment has bimetallic valve flaps 31, 32 on the inner walls of the disks 21, 22.

The bimetallic valve flaps 31, 32 cover the ends of the passages 27, 28 opening into the storage chamber 24, respectively, to close the passages 27, 28 when the heater is not operating or is operating to generate low heat. As the temperature increases, the valve flaps 31, 32 are deformed to open the passages 27, 28.

More specifically, the valve flaps 31, 32 close the passages 27, 28 when the heater is operating to generate little heat. Rotation of the rotor 20 causes the silicone oil F to be supplied to the peripheral region about the rotor 20 through the holes 25. Since the oil F is not returned to the chamber 24 from the passages 27 and 28, the amount of the oil F quickly increases in the peripheral region. Thus, when the heater starts to operate, the heat generation per revolution is increased quickly, and the temperature of the circulating water is rapidly increased, accordingly.

When the temperature of the silicone oil F increases excessively, the valve flaps 29 close the holes 25, and the bimetallic valve flaps 31, 32 are deformed to open the passages 27, 28. This completely stops the supply of oil F from the chamber 24 to the peripheral region and permits flow of the oil F from the end face region of the rotor 20 into the storing chamber 24 through the passages 27, 28. Guided by the Weissenberg effect, the amount of the oil F in the peripheral region gradually decreases. This lowers the heat production per revolution thereby lowering the temperature of the oil F. When the temperature of the oil F is lowered to a certain level, the valve flaps 31, 32 close the passages 27, 28 and the valve flaps 29 open the holes 25. Thus, the oil F is supplied from the chamber 24 to the peripheral region through the holes 25 again. This restores the heat production of the heater.

In this manner, the heat production of the heater is self-controlled by the cooperation of the valve flaps 29 and the valve flaps 31, 32. The cooperation also prevents the temperature of the silicone oil F from increasing excessively. Therefore, the third embodiment illustrated in FIG. 2 has the same advantages as the first embodiment.

Figure 2:
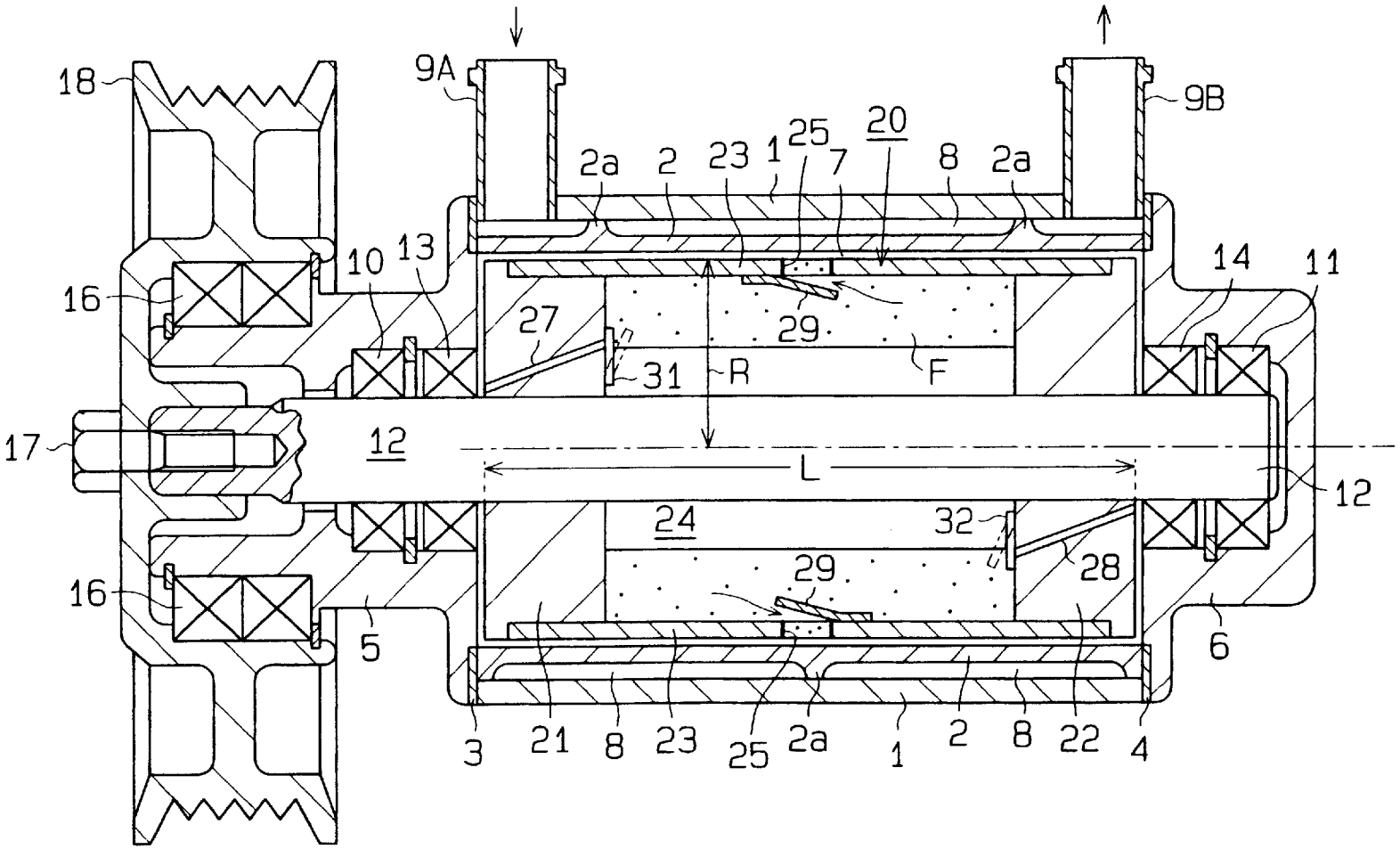
FIG. 2 is a cross-sectional view illustrating a viscous fluid heater according to a third embodiment of the present invention.
Figure 4:
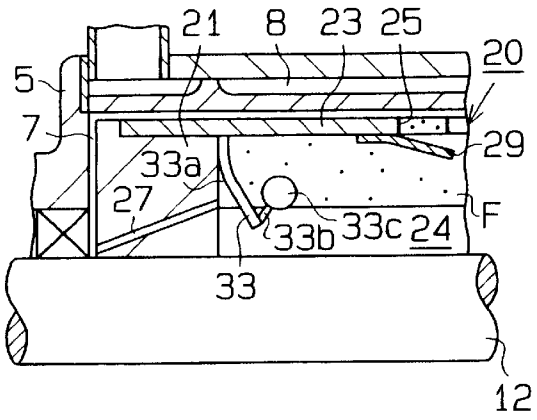
FIG. 4 is an enlarged partial cross-sectional view illustrating the operation of the heater of FIG. 3.
Figure 3:
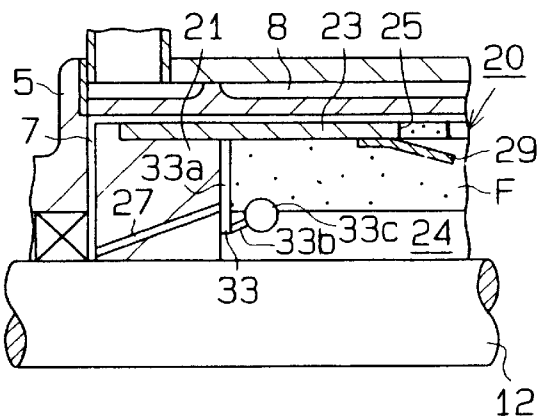
FIG. 3 is an enlarged partial cross-sectional view illustrating a viscous fluid heater according to a fourth embodiment of the present invention.

A viscous fluid heater according to a fourth embodiment is illustrated in FIGS. 3 and 4. This heater has the same basic construction as the heater of the third embodiment illustrated in FIG. 2. However, the heater of FIGS. 3 and 4 is different from the heater of FIG. 2 in that special reed valve flaps 33 are provided on the inner wall of the disks 21 and 22 instead of bimetallic valve flaps 31, 32.

One of the reed valve flaps 33 is illustrated in FIG. 3. Each valve flap 33 includes a leaf spring 33*a*, an arm 33*b* extending from the distal end of the spring 33*a* and weight 33*c* secured to the arm 33*b*. The reed valve flap 33 completely closes the corresponding passage 27 (28) when the rotor 20 is not rotating (see FIG. 3). As the angular velocity of the rotor 20 increases, the centrifugal force acting on the valve flap 33 is increased accordingly. Especially, the weight 33*c* at the distal end of the arm 33*b* is subjected to a great centrifugal force. This locally emphasized centrifugal force bends the leaf spring 33*a* against its spring force and opens the passage 27 (see FIG. 4). In other words, the reed valve flap 33 functions to control the opening of the passage 27 in accordance with the angular velocity of the rotor 20.

More specifically, when the rotor 20 is rotating at a low speed (or when the heater is generating little heat), the passages 27 and 28 are closed by the valve flaps 33. Rotation of the rotor 20 causes the oil F in the storing chamber 24 to be supplied to the peripheral region. Since the oil F is not returned to the chamber 24 from the passages 27 and 28, the amount of the oil F quickly increases in the peripheral region. Thus, when the heater starts to operate, the heat production per revolution is increased quickly and the temperature of the circulating water is rapidly increased, accordingly.

When the temperature of the silicone oil F increases excessively, the valve flaps 29 close the holes 25 and the reed valve flaps 33 are deformed to open the passages 27, 28. This completely stops the supply of oil F from the chamber 24 to the peripheral region and permits flow of the oil F from the end face region of the rotor 20 into the storing chamber 24 through the passages 27, 28. Guided by the Weissenberg effect, the amount of the oil F in the peripheral region gradually decreases. This lowers the heat production per revolution.

When the temperature of the oil F is lowered to a certain level by a decrease in the heat production of the heater, the valve flaps 29 open the holes 25. Thus, the oil F is again supplied from the storing chamber to the peripheral region. This restores the heat production of the heater. Further, when the angular velocity of the rotor 20 is lowered to a certain level, the force of the leaf spring 33*a* becomes greater than the opposing centrifugal force acting on the valve flaps 33. Accordingly, the valve flaps 33 close the passages 27, 28. This stops flow of oil F from the end face regions to the chamber 24. Since the oil F is not returned to the chamber 24 from the passages 27 and 28, the amount of the oil F quickly increases in the peripheral region. Thus, the heat production of the heater is quickly increased.

In this manner, the heat production per revolution is self-controlled by the cooperation of the valve flaps 29 and the valve flaps 33. The cooperation also prevents the temperature of the silicone oil F from increasing excessively. Therefore, the fourth embodiment illustrated in FIGS. 3 and 4 has the same advantages as the first embodiment.

The present invention may be further embodied as follows.

The second embodiment and the embodiment of FIG. 2 may be combined. That is, a heater may have the reed valve flaps 29 for the holes 25 and the bimetallic valve flaps 31, 32 for the passages 27, 28.

The second embodiment and the fourth embodiment may be combined. That is, the heater may have the reed valve flaps 29 for the holes 25 and the reed valve flaps 33 for the passages 27, 28.

Figure 5:
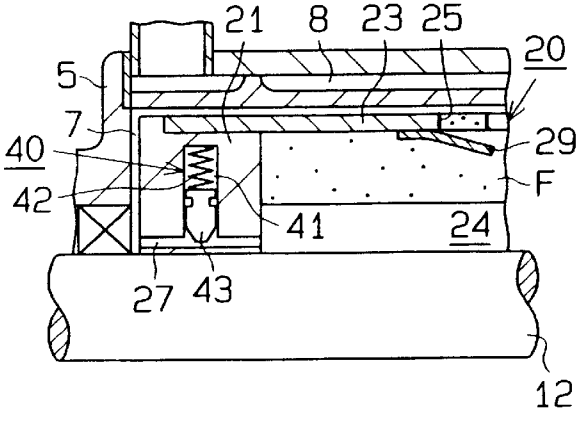
FIG. 5 is an enlarged partial cross-sectional view illustrating a viscous fluid heater according to another embodiment.

In the viscous fluid heaters of FIGS. 1–4, the passages 27, 28 may be parallel to the drive shaft 12 (see FIG. 5).

As shown in FIG. 5, a valve mechanism 40 may be provided in the disks 21 and 22 (only one of which is shown). The mechanism 40 includes a recess 41 that communicates with the passage 27 and is located opposite to the drive shaft 12. A spring 42 and a valve body 43 are accommodated in the recess 41. The spring 42 urges the valve body 43 toward the drive shaft 12. When the rotor 20 is not rotating, the distal end of the valve body 43 is located in the passage 27 to close the passage 27. As the angular velocity of the rotor 20 increases, the centrifugal force moves the valve body 43 into the recess 41 against the force of the spring 42, thereby opening the passage 27. Therefore, the embodiment of FIG. 5 has substantially the same advantages as the fourth embodiment illustrated in FIGS. 3 and 4.

An electromagnetic clutch may be located between the pulley 18 and the drive shaft 12 for selectively transferring the drive force of the engine to the drive shaft 12 as necessary.

The term "viscous fluid" in this specification refers to any type of medium that generates heat based on fluid friction when sheared by a rotor. The term is therefore not limited to highly viscous fluid or semi-fluid material, much less to silicone oil.

Therefore, the present examples and embodiments are to be considered as illustrative and not restrictive and the invention is not to be limited to the details given herein, but may be modified within the scope and equivalence of the appended claims.

What is claimed is:

1. A viscous fluid heater comprising a heating chamber having an inner peripheral surface and an inner side surface and a heat exchange chamber disposed adjacent to the heating chamber, a rotatable cylindrical rotor housed within said heating chamber, said rotor having an outer peripheral surface and an outer side surface, said outer peripheral surface being opposed to said inner peripheral surface by a first space, said side surface being opposed to said inner side surface by a second space communicating with the first space, wherein rotation of said rotor shears viscous fluid to generate heat in the spaces and the heat generated in the first and second spaces is transmitted to the heat exchange chamber to heat circulating fluid circulating in the heat exchange chamber and an external fluid circuit and passing through the heat exchange chamber;

a storage chamber defined in the rotor for storing viscous fluid;

a first passage for connecting said first space with the storage chamber to shift viscous fluid from the storage chamber to the first space;

a second passage for connecting said second space with the storage chamber to shift viscous fluid from the second space to the storage chamber; and valve means actuated in response to the heat generating capacity of the rotor to adjust the flow of the viscous fluid passing through at least one of the first passage and the second passage.

2. The heater as set forth in claim 1, wherein said rotor has an axis about which the rotor rotates, and wherein said second passage is open to said second space in the vicinity of said axis.

3. The heater as set forth in claim 2, wherein said first passage has a cross sectional area larger than that of the second passage.

4. The heater as set forth in claim 1, wherein said valve means includes a bimetallic flapper valve to adjust the flow of the viscous fluid in the first passage, and wherein said bimetallic flapper valve is actuated to decrease the flow in association with an increase in the temperature of the viscous fluid.

5. The heater as set forth in claim 1, wherein said valve means includes a reed valve actuated to decrease the flow of the viscous fluid in the first passage in association with an increase in the rotation speed of the rotor.

6. The heater as set forth in claim 1, wherein said valve means includes a bimetallic flapper valve to adjust the flow of the viscous fluid in the second passage, and wherein said bimetallic flapper valve is actuated to increase the flow in association with an increase in the temperature of the viscous fluid.

7. The heater as set forth in claim 1, wherein said valve means includes a reed valve actuated to increase the flow of the viscous fluid in the passage in association with an increase in the rotation speed of the rotor.

8. The heater as set forth in claim 3, wherein said valve means includes a valve body and a coil spring for biasing the valve body to close the second passage, and said valve body opens the second passage against a force of the coil spring in association with an increase in the rotation speed of the rotor.

9. The heater as set forth in claim 1, further comprising:

a housing; and a cylinder block accommodated in the housing;

wherein said heat exchange chamber includes a water jacket defined between the housing and cylinder block, said water jacket having an inlet and an outlet, said inlet and said outlet communicating with the external fluid circuit.

10. A viscous fluid heater comprising a heating chamber and a rotatable rotor accommodated therein, wherein rotation of said rotor shears viscous fluid between a first space substantially extending along an axis of the heating chamber and a second space substantially perpendicularly extending to the first chamber, and wherein said first space and said second space communicate with each other;

a storage chamber defined in the rotor for storing viscous fluid;

a first passage for connecting the first space with the storage chamber to discharge the viscous fluid from the storage chamber to the first space;

a second passage for connecting the second space with the storage chamber to supply the viscous fluid from the second space to the storage chamber, said second passage being open to the second space in the vicinity of the axis and having a cross-sectional area smaller than the first passage; and a first valve actuated in association with heat generating capacity for adjusting the flow of the viscous fluid passing through the first passage.

11. The heater as set forth in claim 10, wherein said first valve includes a bimetallic flapper valve to adjust the flow of the viscous fluid in the first passage, and said bimetallic flapper valve is actuated to decrease the flow in association with an increase in the temperature of the viscous fluid.

12. The heater as set forth in claim 10, wherein said first valve includes a reed valve actuated to decrease the flow of the viscous fluid in the first passage in association with increase in the rotation speed of the rotor.

13. The heater as set forth in claim 10, further comprising a second valve for adjusting the flow of the viscous fluid in the second passage, wherein said second valve is actuated inversely with respect to the first valve.

14. The heater as set forth in claim 13, wherein said second valve includes a bimetallic flapper valve to adjust the flow of the viscous fluid in the second passage, and said bimetallic flapper valve is actuated to increase the flow in association with an increase in the temperature of the viscous fluid.

15. The heater as set forth in claim 13, wherein said second valve includes a reed valve actuated to increase the flow of the viscous fluid in the second passage in association with an increase in the rotation speed of the rotor.

16. The heater as set forth in claim 13, wherein said second valve includes a valve body and coil spring for biasing the valve body to close the second passage, and said valve body opens the second passage against the force of the coil spring in association with an increase in the rotation speed of the rotor.

17. The heater as set forth in claim 13, wherein said viscous fluid is forcibly introduced to the second passage by the Weissenberg effect.

18. The heater as set forth in claim 13, wherein the viscous fluid occupies at most seventy percent of a whole capacity of the heating chamber.

19. The heater as set forth in claim 13, wherein said viscous fluid includes silicone oil.

20. A viscous fluid heater comprising:

a heating chamber having an inner peripheral surface and an inner side surface;

a heat exchange chamber disposed adjacent to the heating chamber;

a rotatable cylindrical rotor housed within said heating chamber, said rotor having an outer peripheral surface and an outer side surface, said outer peripheral surface being opposed to said inner peripheral surface by a first space, said side surface being opposed to said inner side surface by a second space communicating with the first space, wherein rotation of said rotor shears viscous fluid to generate heat in the first and second spaces and the heat generated in the first and second spaces is transmitted to the heat exchange chamber to heat fluid circulating in the heat exchange chamber and an external fluid circuit and passing through the heat exchange chamber;

a storage chamber defined in the rotor for storing viscous fluid;

a first passage for connecting the first space with said storage chamber to shift viscous fluid from said storage chamber to the first space;

a second passage for connecting said second space with said storage chamber to shift viscous fluid from the second space to said storage chamber; and a first reed valve actuated to decrease the flow of the viscous fluid in the first passage in association with an increase in the rotation speed of said rotor; and a second reed valve actuated to increase the flow of the viscous fluid in the passage in association with an increase in the rotation speed of the rotor.

* * * * *